United States Patent [19]

Kirst et al.

[11] Patent Number: 4,693,168

[45] Date of Patent: Sep. 15, 1987

[54] METHOD AND APPARATUS FOR AIMING INDIRECTLY AIMABLE WEAPONS

[75] Inventors: Bertold Kirst, Lilienthal; Otto Beyer, Freiburg; Wolfgang Lipp, Denzlingen, all of Fed. Rep. of Germany

[73] Assignee: Litef GmbH, Freiburg im Breisgau, Fed. Rep. of Germany

[21] Appl. No.: 916,537

[22] Filed: Oct. 8, 1986

[30] Foreign Application Priority Data

Oct. 14, 1985 [EP] European Pat. Off. ..... 85113032.8

[51] Int. Cl.[4] ..... F41G 3/10

[52] U.S. Cl. ..... 89/41.11; 364/423

[58] Field of Search ..... 89/41.02, 41.11, 41.14, 89/41.19, 41.21; 364/423; 33/240

[56] References Cited

FOREIGN PATENT DOCUMENTS 102664 3/1984 European Pat. Off. ..... 89/41.19

3125678 1/1983 Fed. Rep. of Germany ..... 89/41.19

*Primary Examiner*—Stephen C. Bentley

*Assistant Examiner*—Stephen M. Johnson

*Attorney, Agent, or Firm*—Elliott N. Kramsky

[57] ABSTRACT

A method and apparatus for aiming indirectly aimable weapons free from tipping and tilting angle and independent of the oblique position of the weapon. The position of the weapon is supplied with respect to an earth coordinate system by a position reference system. These values, along with theoretical angular values derived through ballistics computations, are separately converted to a coordinate system that is fixed with respect to a weapon platform. The weapon is aimed in accordance with differences formed between the theoretical and actual positions of the weapon. A cross-hair that indicates actual position is displaced laterally on a screen when the weapon is pivoted and vertically when the weapon is raised or lowered. The lateral and elevation movements of the weapon are decoupled allowing the correct position to be directly and independently set with respect to both axes.

11 Claims, 5 Drawing Figures

METHOD AND APPARATUS FOR AIMING INDIRECTLY AIMABLE WEAPONS

BACKGROUND

1. Field of the Invention

The present invention relates to a method and apparatus for the aiming of indirectly aimable weapons such as artillery equipment. More particularly, this invention pertains to an aiming method and apparatus therefor that are free from tipping and tilting angle.

2. Description of the Prior Art

In the setting of artillery equipment on a specified target, a multiplicity of data items must be processed and considered from the point of view of the operating personnel. In this regard, there arises a particular problem in setting the attitude of the gun and its location in three-dimensional space. Indeed, if the gun is situated in an oblique position so that the trunnion axis is tilted, an iterative process is required for aiming the barrel. Movement about the tilted trunnion axis effects a lateral pivoting of the weapon requiring a lateral readjustment that, in turn, causes it to be displaced through a certain angle of elevation.

SUMMARY

It is, therefore, an object of this invention to provide a method and apparatus for aiming a weapon independent of the position of a carrier and free from tipping and tilting angle so that a substantial increase in aiming speed is achieved and previously required iterative processes are dispensed with.

It is a further object of the invention to provide a substantially improved and clearer presentation of aiming data.

The preceding and other shortcomings of the prior art are addressed and overcome by the present invention which provides, in a first aspect, a method for aiming an indirectly aimable weapon. Such method includes the steps of specifying and storing the theoretical bearing and angle of elevation of the weapon with respect to a first coordinate system fixed in relation to the earth and determining and storing the actual bearing and angle of elevation of the weapon in such first coordinate system. The tilting angle, tipping angle and bearing of a second coordinate system, fixed in relation to a weapon support, are determined with respect to the first coordinate system, and stored. Thereafter, the actual and theoretical bearing and angle of elevation of the weapon are continuously computed with respect to the second coordinate system. Then the differences between the theoretical and actual bearings and angle of elevation are continuously determined and the weapon is driven in accordance with such differences.

In another aspect, this invention provides apparatus for aiming an indirectly aimable weapon which is mounted to a platform. Such apparatus includes means for computing the theoretical bearing, $\beta_2$, and angle of elevation, $\alpha_2$, of the weapon with respect to earth. Means, fixed to the platform, are provided for measuring the values of: actual bearing, $\beta_1$, and angle of elevation, $\alpha_1$, of the weapon with respect to earth; the tilting angle, $\Phi$, tipping angle, $\Theta$, and bearing, $\Psi$, of the platform with respect to eart. A computing unit is arranged to accept the values of $\beta_2$, $\alpha_2$, $\beta_1$, $\alpha_1$, $\Phi$, $\Theta$ and $\Psi$ and to calculate the instantaneous values of theoretical bearings, $\beta'_2$, actual bearing $\alpha'_1$, theoretical angle of elevation, $\alpha'_2$, and actual angle of elevation, $\alpha'_1$, of the weapon with respect to the platform.

Means in communication with the computing unit are additionally provided for continuously forming the differences $(\alpha'_2-\beta'_1)$ and $(\alpha'_2-\alpha'_1)$. Finally, means are provided responsive to such differences for controlling the position of the weapon.

The foregoing features and advantages of this invention will become further apparent from the detailed written description which follows. The written description is accompanied by a set of drawing figures. Numerals of the figures, corresponding to like numerals of the written description, point out the features of this invention like numerals referring to like features throughout the written description and drawings.

DETAILED DESCRIPTION

Figure 1:
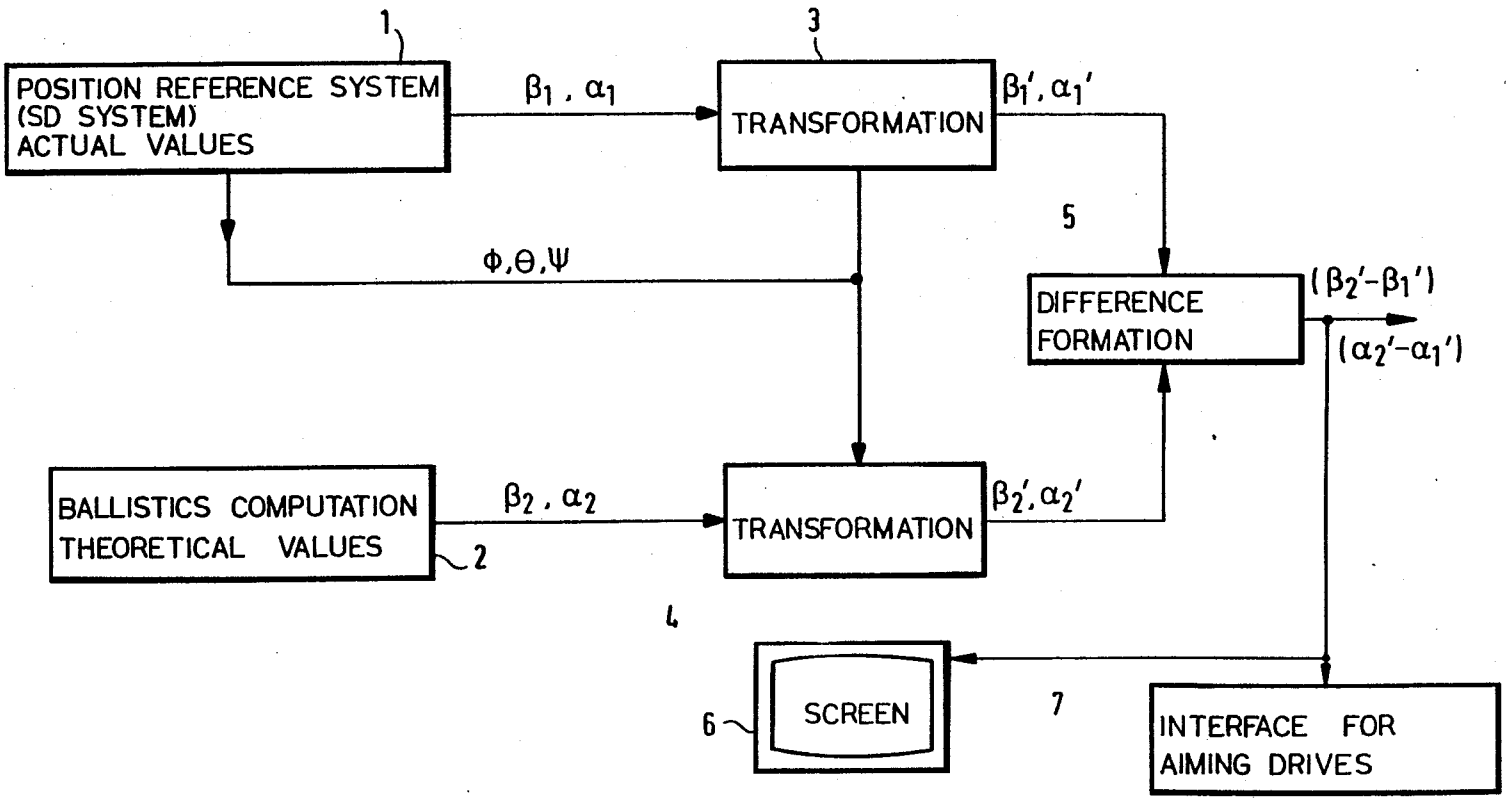
FIG. 1 is a block flow diagram of the method and apparatus in accordance with the present invention.

A detailed description of the invention, its theoretical basis and arrangement follows. Reference to the vector diagrams of FIGS. 3(*a*) through 3(*c*) will clarify the angular relationships discussed infra.

In a coventionally employed navigation coordinate system ("n system") that is fixed in relation to the earth the $x_n$ axis points north (grid north), the $y_n$ axis points east, and the $z_n$ axis points down. The position of a coordinate system fixed in relation to a body (b or "body system") is chosen so that the $x_b y_b$ plane of the system is perpendicular to a drive axis of rotation. The position of the $x_b$ system in the plane is, in principle, freely selectable although determined in accordance with the position reference system. After the $x_b$ axis is specified, the $y_b$ axis points right in relation thereto in the $x_b y_b$ plane, and the $z_b$ axis coincides with the drive axis of rotation, thereby creating a right-handed system with the $z_b$ axis pointed "downwards."

The following quantities are available for aiming independent of tipping and tilting angle:

(a) Quantities that are known from specifications derived from fire control system computations:

$\beta_2$: Index ring (bearing of the theoretical position in the n system); and $\alpha_2$: Elevation (angle of elevation of the theoretical position in the n system).

(b) The strapdown (hereinafter "SD") system supplies the following:

$\beta_1$: Index ring (bearing of the actual position in the n system);

$\alpha_1$: Elevation (angle of elevation of the actual position in the n system);

$\Phi$: Tilting angle of the weapon (coordinate system fixed in relation to the body, b system as compared with the n system);

$\Theta$: Tipping angle of the b system relative to the n system; and $\Psi$: Bearing of the b system relative to the n system.

The following quantities are required for aiming free from tipping and tilting angle:

$\beta'_1$, $\beta'_2$ bearing of the weapon, in each instance, for the actual and theoretical position in the b system; and $\alpha'_1$, $\alpha'_2$ elevation of the weapon, in each instance, for the actual and the theoretical position in the b system.

A transformation from the navigation coordinate system to the coordinate system fixed in relation to the body may be described with the aid of a matrix:

$$\vec{\gamma}b = C_n{}^b \vec{\gamma}n$$

where: b=system fixed in relation to the body; and n=navigation system with:

$$C_n{}^b = C_x(\Phi) \cdot C_y(\theta) \cdot C_z(\Psi)$$

In the foregoing expressions, subscripts denote axes of rotation, and arguments denote angles of rotation (e.g. $C_y$ ($\Theta$) represents rotation through the angle $\Theta$ about the Y axis.

It follows from the foregoing that:

$$C_n{}^b = \begin{Bmatrix} 1 & 0 & 0 \\ 0 & \cos\phi & \sin\phi \\ 0 & -\sin\phi & \cos\phi \end{Bmatrix} \begin{Bmatrix} \cos\theta & 0 & -\sin\theta \\ 0 & 1 & 0 \\ \sin\theta & 0 & \cos\theta \end{Bmatrix} \begin{Bmatrix} \cos\psi & \sin\psi & 0 \\ -\sin\psi & \cos\psi & 0 \\ 0 & 0 & 1 \end{Bmatrix} \quad (1)$$

$$C_n{}^b = \begin{Bmatrix} \cos\theta\cos\psi & \cos\theta\sin\psi & -\sin\theta \\ -\cos\phi\sin\psi + \sin\phi\sin\theta\cos\psi & \cos\phi\cos\psi + \sin\phi\sin\theta\sin\psi & \sin\phi\cos\theta \\ \sin\phi\sin\psi + \cos\phi\sin\theta\cos\psi & -\sin\phi\cos\psi + \cos\phi\sin\theta\sin\psi & \cos\phi\cos\theta \end{Bmatrix}$$

Figure 3A:
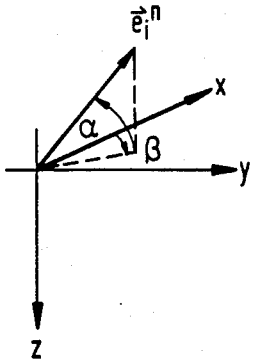
FIGS. 3*a* through 3*c* are vector diagrams which illustrate transformations that take place in the continuous computation of weapon bearing and angle of elevation for aiming in accordance with the method of the invention.
Figure 3B:
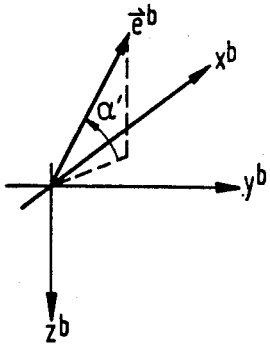
Figure 3C:
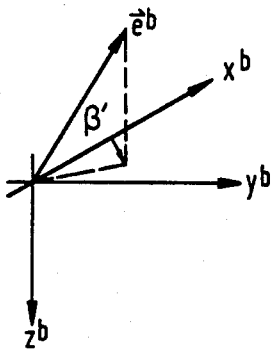

Representing barrel direction as the unit vector $e_i$. (i=1,2) wherein $e_1$ is the current barrel direction (actual) and $e_2$ is the desired barrel direction (theoretical), the following expressions are obtained (a superscript on the right designates the particular coordinate system):

$$\vec{e_1}{}^b = C_n{}^b \vec{e_1}{}^n \vec{e_2}{}^b = C_n{}^b \vec{e_2}{}^n \text{ with} \quad (2)$$

$$\vec{e_i}{}^n = \begin{Bmatrix} \cos\alpha_i\cos\beta_i \\ \cos\alpha_i\sin\beta_i \\ -\sin\alpha_i \end{Bmatrix} \quad i = 1, 2$$

Where $\alpha_i$ represents elevation and $\beta_i$ represents index ring, with respect to the system of, for example, FIG. 3*a*, infra (x axis aligned with grid north, z axis aligned downward).

In the coordinate system fixed in relation to the body, the barrel direction $e_i{}^b$ is represented as follows:

$$C_n{}^b \vec{e_i}{}^n = \begin{Bmatrix} c\theta c\psi c\alpha_i c\beta_i + c\theta s\psi c\alpha_i s\beta_i + s\theta s\alpha_i \\ -c\phi s\psi c\alpha_i c\beta_i + s\phi s\theta c\psi c\alpha_i c\beta_i + c\phi c\psi c\alpha_i s\beta_i + \\ s\phi s\psi c\alpha_i c\beta_i + c\phi s\theta c\psi c\alpha_i c\beta_i - s\phi c\psi c\alpha_i s\beta_i + \\ s\phi s\theta s\psi c\alpha_i s\beta_i - s\phi c\theta s\alpha_i \\ c\phi s\theta s\psi c\alpha_i s\beta_i - c\phi c\theta s\alpha_i \end{Bmatrix} \quad (3)$$

In the above expression "c" represents the cosine and "s" represents the sine of the angle that follows. Thus, for the elevation in the system fixed in relation to the body, and with reference to FIG. 3(*b*) as well as with the unit vector $$l = \sqrt{|\vec{e}^b|^2} = 1$$

The relation:

$$\sin\alpha_i' = \frac{-e_{zi}^b}{l} = -e_{zi}^b$$

If the representation of $\vec{e_i}{}^b$ according to equation (3) is used, then the following is obtained:

$$\sin\alpha_1' = -[\sin\phi\sin\Psi + \cos\phi\sin\theta\cos\Psi]\cos\alpha_i\cos\beta_i + [\sin\phi\cos\Psi - \cos\phi\sin\theta\sin\Psi]\cos\alpha_i\sin\beta_i + [\cos\phi\cos\theta]\sin\alpha_i \quad (4)$$

In the preceding expressions, $\Phi$, $\Theta$, and $\Psi$ designate the course angles of the system with respect to the body, while $\beta_i$ and $\alpha_i$ designate the index ring and elevation of the weapon with respect to the navigation coordinate system. The following relationship applies to the orientation of the index ring in the coordinate system of the body (shown in FIG. 3*c*.

$$t_g\beta_i' = e_{yi}^b / e_{xi}^b \quad (5a)$$

with $$e_{yi}^b = [\sin\phi\sin\theta\cos\Psi - \cos\Phi\sin\Psi]\cos\alpha_i\cos\beta_i + [\sin\phi\sin\theta\sin\Psi + \cos\phi\cos\Psi]\cos\alpha_i\sin\beta_i + [\sin\phi\cos\theta]\sin\alpha_i \quad (5b)$$

$$e_{xi}^b = [\cos\theta\cos\Psi]\cos\alpha_i\cos\beta_i + [\cos\theta\sin\Psi]\cos\alpha_i\sin\beta_i + [\sin\theta]\sin\alpha_i \quad (5c)$$

In practice, computation of $\beta'_i$ is preferably accomplished by a computer program that utilizes the inverse tangent function, so that the ambiguities of this function are eliminated.

In an SD system in accordance with the teachings of the invention, the coordinate system fixed in relation to the body is defined by $\Psi=\beta_1$. That is, the $x_b$ axis is rotated by the angle $\beta_1$ relative to the $x_n$ axis. Accordingly, the following relations, obtained from equations (4) and (5), after a simple transformation apply:

$$\tan\beta'_1 = \sin\Phi\tan(\alpha_1 - \Theta) \quad (6a)$$

$$\sin\alpha'_1 = \cos\Phi\sin(\alpha_1 - \Theta) \quad (6b)$$

The preceding equations for $\beta'_2$ and $\alpha'_2$ cannot be further simplied by the relation $\Psi=\beta_1$. Thus they remain in their unchanged forms. If, for a particular application, the position and angle of pivoting are limited to restricted angular ranges, approximations, in accordance with the desired accuracy, may be employed in the computation of $\beta'_1$, $\beta'_2$ and $\alpha'_1$, $\alpha'_2$. The abovereferenced procedure will now be illustrated with reference to the following example.

EXAMPLE

The actual barrel position represented by sighting angle $\beta_1$ and elevation $\alpha_1$ in the earth coordinate system (n system), and course angles $\Phi$, $\Theta$, $\Psi=\beta_1$ of the body coordinate system (b system) are supplied by an analytical platform. The theoretical position of the barrel is then specified (e.g., in a firing command) by the values of index ring $\beta_2$ and elevation $\alpha_2$. The corresponding bearings $\beta'_1$ and $\beta'_2$ and the angles of elevation $\alpha'_1$ and $\alpha'_2$ in the b coordinate system are then computed continuously in accordance with equations (4), (5) and (6), as the b coordinate system moves relative to the n coordinate system whenever the turret or another weapon mounting moves relative to the chassis of the supporting system. Only angles $\beta_2$ and $\alpha_2$ remain unchanged throughout the pivoting process.

Figure 2:
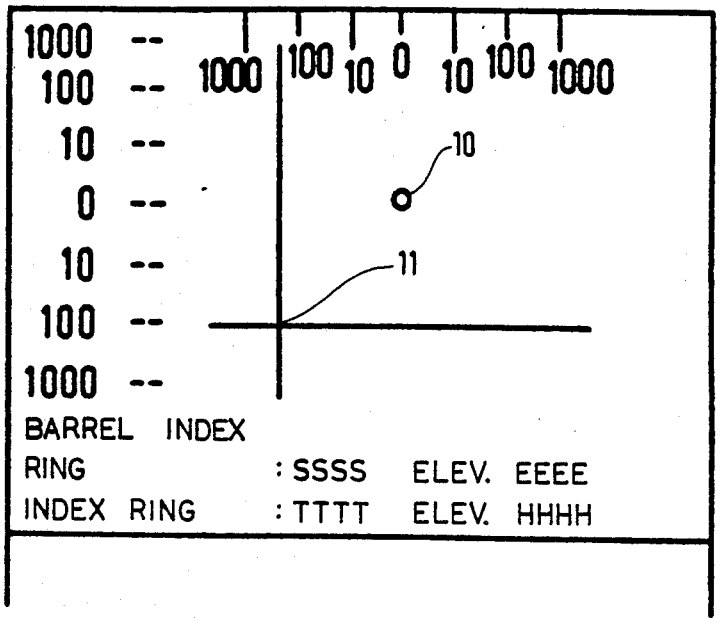
FIG. 2 is a visual screen display in accordance with the invention.

The angular difference values $(\beta'_2-\beta'_1)$ and $(\alpha'_2-\alpha'_1)$, bearing difference and angle of elevation difference respectively (each in the b coordinate system), are graphically displayed on the screen of a display unit in accordance with the format illustrated in FIG. 2. A logarithmic scale is employed on both axes for purposes of accuracy and clarity in presentation. As an alternative, selectable resolution may be employed. In such a technique the first adjustment of the scale establishes a coarse setting. Then, fine aiming of the weapon can be undertaken by application of pressure to a key to adjust a scale having an extended raster graduation (magnifier). Such a technique permits a larger angular range to be displayed, while allowing resolution of small angle differences. The theoretical and actual position are further displayed digitally relative to the coordinate system fixed in relation to the earth. The required computing capacity and the interface with the analytical platform are integrated into the microprocessor-controlled display unit.

The angles $(\beta'_2-\beta'_1)$ and $(\alpha'_2-\alpha'_1)$ determining aiming procedure are displayed graphically, as in FIG. 2. As displayed in the figure, a small circle designated by reference numeral 10 represents the theoretical position, and a movable cross-hair 11 represents the actual position. As mentioned earlier, the angular differences between the theoretical and the actual positions in the b system are presented on a logarithmic scale for purposes of clarity.

For monitoring purposes, the angles of the theoretical and actual positions in the n system may also be displayed digitally. At the lower edge of the screen the word "AIM" flashes until such time as the angular difference between the theoretical and actual positions falls within a predetermined threshold tolerance range.

FIG. 1 is a block diagram of the basic structural arrangement of a device in accordance with the invention. A position reference system (strapdown system), indicated by numeral 1, provides the actual values of angles $\beta_1$, $\alpha_1$, $\Phi$, $\Theta$, and $\Psi$ for a coordinate system that is fixed in relation to the earth (n system). Theoretical aiming values (bearing $\beta_2$ and angle of elevation $\alpha_2$ in the n system) are specified by fire control computation (ballistics computation 2). Transformations 3 and 4 compute the actual and theoretical values of the bearings $\beta'_1$, $\beta'_2$ and of the angle of elevation $\alpha'_1$, $\alpha'_2$ of the weapon in the b system in accordance with the abovereferenced equations. Difference formation 5 then provides difference angles $(\beta'_2-\beta'_1)$ and $(\alpha'_2-\alpha'_1)$ that may either be displayed in a screen 6 in accordance with the formats disclosed and described with reference to FIG. 2 or fed to interfaces 7 of the weapon aiming drives.

Thus it is seen that the present invention provides a novel method and apparatus for aiming indirectly aimable weapons. The method and apparatus in accordance with the invention can be employed for the indirect aiming of conventional artillery guns or ballistic rocket launchers. An analytical platform, such as a strapdown system, may serve as a position reference system. Such a position reference system provides the position of the weapon in three-dimensional space; that is, with reference to a coordinate system that is fixed in relation to earth. The theoretical and actual positions of the weapon are preferably presented graphically. Thus, the theoretical position of the weapon is represented by a (stationary) small circle while its actual position is indicated by a (movable) cross-hair in much the same way that a target (circle) is viewed through a telescopic sight (crosshair). Weapon aiming, free from tipping and tilting angle, takes place independent of the oblique position of the aiming mechanism. During aiming, the crosshair is displaced laterally when the weapon is pivoted, and vertically when the weapon is raised or lowered. This simplifies the aiming process considerably, allowing more rapid aiming as the lateral and elevation movements of the weapon are decoupled on the display. Thus the weapon's position can be set, in laterally correct orientation, directly and independently, with respect to both axes of movement. The advantages of the invention over conventional artillery equipment that requires a division of functions between two aiming operators are considerable. Tilt-free aiming permits regulation of the angle of elevation by tilting the trunnion axis in a single operation to the correct value. The influence of subsequent lateral aiming is already compensated so that a subsequent correction of weapon elevation is not required.

By simplifying aiming procedures substantially, aiming operators can concentrate more on their other functions. Alternatively, the entire aiming procedurae can be carried out by a single operator.

While the invention has been disclosed with respect to a presently preferred embodiment, its scope is not so limited. Rather such scope is limited only insofar as defined by the following set of claims.

What is claimed is:

1. A method for aiming an indirectly aimable weapon comprising the steps of:

a. specifying and storing the theoretical bearing and angle of elevation of the weapon with respect to a first coordinate system fixed in relation to the earth; and b. determining and storing the actual bearing and angle of elevation of the weapon in said first coordinate system; and c. determining and storing the tilting angle, tipping angle and the bearing of a second coordinate system, fixed in relation to a weapon support, with respect to the first coordinate system; then d. continuously computing the actual and theoretical bearing and angle of elevation of said weapon with respect to said second coordinate system; then e. continuously determining the differences between the theoretical and actual bearings and angles of elevation; and then f. driving said weapon in accordance with said differences.

2. A method as defined in claim 1 further including the step of visually displaying said theoretical and actual positions of said weapon.

3. Apparatus for aiming an indirectly aimable weapon mounted to a platform comprising, in combination:

a. means for computing the theoretical bearing, $\beta_2$, and angle of elevation, $\alpha_2$, of said weapon with respect to earth;

b. means fixed to said platform for measuring the values of: actual bearing, $\beta_1$, and angle of elevation, $\alpha_1$, of said weapon with respect to earth; tilting angle, $\Phi$, tipping angle, $\Theta$, and bearing, $\Psi$, of said platform with respect to earth;

c. a computing unit arranged to accept the values of $\beta_2$, $\alpha_2$, $\beta_1$, $\alpha_1$, $\Phi$, $\Theta$ and $\Psi$ and to calculate the instantaneous values of theoretical bearing, $\beta'_2$, actual bearing, $\beta'_1$, theoretical angle of elevation, $\alpha'_2$, and actual angle of elevation, $\Gamma'_1$ of said weapon with respect to said platform;

d. means in communication with said computing unit for continuously forming the difference $(\beta'_2-\beta'_1)$ and $(\alpha'_2-\alpha'_1)$; and e. means responsive to said differences for controlling the position of said weapon.

4. Apparatus as defined in claim 3 further including a screen responsive to the differences $(\beta'_2-\beta'_1)$ and $(\alpha'_2-\alpha'_1)$ for visually displaying the actual and theoretical positions of said weapon.

5. Apparatus as defined in claim 4 wherein said screen further includes:

a. orthogonal logarithmically-graduated axes; and b. said theoretical and actual positions of said weapon are represented on said screen by contrasting elements.

6. Apparatus as defined in claim 5 wherein said elements are a circle and a cross-hair.

7. Apparatus as defined in claim 4 wherein said screen further includes:

a. two-axis scale with selectable resolution for coarse and fine aiming; and b. said theoretical and actual positions of said weapon are represented on said screen by contrasting elements.

8. Apparatus as defined in claim 7 wherein said screen further includes:

a. a magnifier; and b. said contrasting elements comprise a circle and a cross-hair.

9. Apparatus as defined in claim 4 further characterized in that different marking elements identify the theoretical and actual positions of said weapon with reference to both axes of rotation on said screen so that said positions are clearly distinguishable.

10. Apparatus as defined in claim 4 further including means for setting an instruction display on said screen when said theoretical and actual positions of said weapon in relation to at least one axis are separated by more than a predetermined amount.

11. Apparatus as defined in claim 4 further including means for computing the difference between the theoretical and the actual positions with respect to said platform.

* * * * *